US010943319B2

(12) United States Patent
Kawasaki et al.

(10) Patent No.: US 10,943,319 B2
(45) Date of Patent: Mar. 9, 2021

(54) INFORMATION PROCESSING SYSTEM, INFORMATION PROCESSING APPARATUS, SERVER, STORAGE MEDIUM HAVING STORED THEREIN INFORMATION PROCESSING PROGRAM, AND INFORMATION PROCESSING METHOD

(71) Applicant: NINTENDO CO., LTD., Kyoto (JP)

(72) Inventors: Takeshi Kawasaki, Kyoto (JP); Takamitsu Akita, Kyoto (JP); Masahiro Sakurai, Tokyo (JP); Nobutaka Sakai, Tokyo (JP); Yasuhito Kobayashi, Tokyo (JP); Mitsuo Kashiwagi, Tokyo (JP); Keita Noto, Tokyo (JP)

(73) Assignee: Nintendo Co., Ltd., Kyoto (JP)

( * ) Notice: Subject to any disclaimer, the term of this patent is extended or adjusted under 35 U.S.C. 154(b) by 672 days.

(21) Appl. No.: 14/658,660

(22) Filed: Mar. 16, 2015

(65) Prior Publication Data

US 2015/0286699 A1 Oct. 8, 2015

(30) Foreign Application Priority Data

Apr. 4, 2014 (JP) ..... JP2014-077530

(51) Int. Cl.
*A63F 11/00* (2006.01)
*G06Q 90/00* (2006.01)

(52) U.S. Cl.
CPC ..... *G06Q 90/00* (2013.01); *A63F 2011/0065* (2013.01)

(58) Field of Classification Search
None
See application file for complete search history.

(56) References Cited

U.S. PATENT DOCUMENTS 5,910,046 A * 6/1999 Wada ..... A63F 13/10 463/6
6,183,365 B1 * 2/2001 Tonomura ..... A63F 13/833 463/36
6,471,586 B1 * 10/2002 Aiki ..... A63F 13/08 434/61
8,357,045 B2 * 1/2013 Youm ..... A63F 13/10 463/42

(Continued)

FOREIGN PATENT DOCUMENTS

JP 2001-297200 A 10/2001
JP 2003-093746 4/2003

(Continued)

OTHER PUBLICATIONS

OA from corresponding Japanese Patent Appln. No. 2014-077530 dated Dec. 22, 2017.

*Primary Examiner* — Ashish Thomas
*Assistant Examiner* — Melissa M. Ohba
(74) *Attorney, Agent, or Firm* — Nixon & Vanderhye, P.C.

(57) ABSTRACT

A ranking of each of a plurality of users is set, and based on a numerical value indicating the ranking, an indicator is calculated such that the smaller the numerical value, the greater a value of the indicator. Then, the indicator calculated for the user is displayed. The indicator is displayed such that the higher the ranking, the greater the value of the indicator. This can enhance the motivation of a user.

20 Claims, 10 Drawing Sheets

(56) References Cited

U.S. PATENT DOCUMENTS 8,366,546 B1 * 2/2013 Naik ..... A63F 13/12 463/31
8,380,709 B1 * 2/2013 Diller ..... G06F 17/3053 707/723
8,430,755 B2 * 4/2013 Youm ..... A63F 13/795 360/131
8,444,490 B2 * 5/2013 Youm ..... A63F 13/795 463/4
8,444,492 B2 * 5/2013 Youm ..... A63F 13/48 463/42
8,496,531 B2 * 7/2013 Youm ..... A63F 13/335 463/42
8,535,134 B2 * 9/2013 Katz ..... G07F 17/3276 463/9
8,548,610 B1 * 10/2013 Howell ..... G06Q 10/0639 273/317.4
8,647,188 B2 * 2/2014 Kelly ..... G07F 17/3267 463/16
8,696,469 B2 * 4/2014 Youm ..... A63F 13/10 463/42
8,715,069 B2 * 5/2014 Arnone ..... G07F 17/3279 463/25
8,920,228 B2 12/2014 Oikawa
9,084,931 B2 * 7/2015 Herrmann ..... G06Q 30/02
9,384,631 B2 * 7/2016 Arnone ..... G07F 17/3279
9,463,388 B2 * 10/2016 Thompson ..... A63F 13/35
9,613,498 B2 * 4/2017 Koustas ..... G07F 17/32
2002/0039923 A1 * 4/2002 Cannon ..... G07F 17/32 463/42
2002/0115488 A1 * 8/2002 Berry ..... A63F 13/12 463/42
2003/0078102 A1 * 4/2003 Okita ..... G06Q 20/381 463/42
2004/0002384 A1 * 1/2004 Multerer ..... A63F 13/12 463/42
2004/0230515 A1 * 11/2004 Crosthwaite ..... G06Q 40/00 705/37
2006/0015392 A1 * 1/2006 Talla ..... G06Q 30/02 705/7.38
2007/0112768 A1 * 5/2007 Majumder ..... G06F 17/30864
2007/0191102 A1 * 8/2007 Coliz ..... A63F 13/795 463/42
2007/0191105 A1 * 8/2007 Azuma ..... A63F 13/12 463/42
2008/0268952 A1 * 10/2008 Ikejiri ..... A63F 13/10 463/31
2009/0024605 A1 * 1/2009 Yang ..... G06F 17/30873
2009/0104960 A1 * 4/2009 Kelly ..... G07F 17/3267 463/16
2009/0117959 A1 * 5/2009 Nicely ..... G07F 17/32 463/13
2009/0247259 A1 * 10/2009 Napolitano ..... G07F 17/3244 463/18
2010/0160038 A1 * 6/2010 Youm ..... A63F 13/10 463/29
2010/0184495 A1 * 7/2010 Levy ..... A63F 13/12 463/4
2010/0240443 A1 * 9/2010 Baerlocher ..... G07F 17/32 463/25
2010/0261536 A1 * 10/2010 Shibamiya ..... A63F 13/12 463/42
2011/0319172 A1 * 12/2011 Imachi ..... G07F 17/3225 463/42
2012/0009997 A1 * 1/2012 Youm ..... A63F 13/497 463/42
2012/0010734 A1 * 1/2012 Youm ..... A63F 13/67 700/92
2012/0021823 A1 * 1/2012 Youm ..... A63F 13/497 463/29
2012/0064968 A1 * 3/2012 Youm ..... A63F 13/335 463/29
2012/0178535 A1 * 7/2012 Short ..... G06Q 40/06 463/42
2012/0283858 A1 * 11/2012 Lapadula ..... A63F 13/828 700/93
2013/0130807 A1 * 5/2013 Youm ..... A63F 13/10 463/43
2013/0254294 A1 * 9/2013 Isaksson ..... G06Q 10/101 709/204
2013/0331177 A1 * 12/2013 Arnone ..... G07F 17/3279 463/25
2014/0155170 A1 * 6/2014 De Waal ..... G07F 17/32 463/40
2014/0243059 A1 * 8/2014 Arnone ..... G07F 17/3279 463/2
2014/0335944 A1 * 11/2014 Hornik ..... G07F 17/3255 463/25
2015/0263925 A1 * 9/2015 Shivashankar ..... H04L 67/306 706/12
2016/0263462 A1 * 9/2016 Curchod ..... A63B 71/0616
2016/0263463 A1 * 9/2016 Curchod ..... A63B 71/0616
2016/0275080 A1 * 9/2016 Xia ..... G06Q 50/01
2016/0314124 A1 * 10/2016 Taniguchi ..... G06F 17/3053

FOREIGN PATENT DOCUMENTS

JP 2004-160100 A 6/2004
JP 2004-243138 9/2004
JP 2013-020195 A 1/2013
JP 5421476 11/2013

* cited by examiner

FIG. 6

IF INFORMATION PROCESSING APPARATUS IS SCORE OUTPUT TARGET CORRESPONDING TO THINNING RATE, AND IF GAME SCORE IN TOP RANKING HAS BEEN UPDATED, GAME SCORE IS OUTPUT

THINNED SCORE MANAGEMENT DATA

| THINNED RANKING | GAME SCORE |
|---|---|
| 1 (TOP RANKING) | 200000 |
| 2 | 190000 |
| 3 | 185090 |
| 4 | 185080 |
| ⋮ | ⋮ |
| N−1 | 100 |
| N (BOTTOM RANKING) | 10 |

TOTAL OF 50 GAME SCORES INCLUDING TOP AND BOTTOM RANKINGS AND VALUE IN BOTTOM RANKING N ARE OUTPUT

USER RANKING = B × (THINNING RATE × (N/TOTAL ACQUISITION NUMBER)

WORLD RANKING POINTS = TOTAL NUMBER OF USERS − USER RANKING + 1
= (N * THINNING RATE) − {B * THINNING RATE * (N/TOTAL ACQUISITION NUMBER)} + 1

INFORMATION PROCESSING SYSTEM, INFORMATION PROCESSING APPARATUS, SERVER, STORAGE MEDIUM HAVING STORED THEREIN INFORMATION PROCESSING PROGRAM, AND INFORMATION PROCESSING METHOD

CROSS REFERENCE TO RELATED APPLICATION

The disclosure of Japanese Patent Application No. 2014-077530, filed on Apr. 4, 2014, is incorporated herein by reference.

FIELD

The technology shown here relates to an information processing system, an information processing apparatus, a server, a storage medium having stored therein an information processing program, and an information processing method, and in particular, relates to an information processing system, an information processing apparatus, a server, and an information processing method for, for example, performing processing based on a list of rankings, and a storage medium having stored therein an information processing program for, for example, performing processing based on a list of rankings.

BACKGROUND AND SUMMARY

Conventionally, a ranking service provision system for providing information regarding the rankings of users operating terminal apparatuses is known. For example, the ranking service provision system counts the scores of and the votes for users and outputs the count results.

In the ranking service provision system, however, if the number of users participating in the rankings is enormous, the ranking of each user may relatively fall. This may reduce the motivation of the user.

Therefore, it is an object of an exemplary embodiment to provide an information processing system, an information processing apparatus, a server, and an information processing method that are capable of enhancing the motivation of a user, and a storage medium having stored therein an information processing program capable of enhancing the motivation of a user.

To achieve the above object, the exemplary embodiment can employ, for example, the following configurations. It should be noted that it is understood that, to interpret the descriptions of the claims, the scope of the claims should be interpreted only by the descriptions of the claims. If there is a conflict between the descriptions of the claims and the descriptions of the specification, the descriptions of the claims take precedence.

In an exemplary configuration of an information processing system according to an exemplary embodiment, an information processing system performs display based on rankings of a plurality of users. The information processing system includes one or more processors configured to: set the ranking of each of the plurality of users; based on a numerical value indicating the ranking, calculate an indicator such that the smaller the numerical value, the greater a value of the indicator; and display the indicator calculated for the user.

Based on the above, an indicator is displayed such that the higher the ranking, the greater the value of the indicator. This makes it possible to enhance the motivation of a user.

In addition, the one or more processors of the information processing system may be further configured to calculate a total number of the plurality of users. In this case, in the calculation of the indicator, the indicator may be calculated based on the total number and the numerical value indicating the ranking.

Based on the above, it is possible to calculate the indicator taking into account the total number of users.

In addition, in the calculation of the indicator, the indicator may be calculated using a value obtained by subtracting the numerical value indicating the ranking from the total number.

Based on the above, even if the ranking of a user is the same, the numerical value of the indicator increases as the total number of users increases. Thus, even if the ranking of the user falls due to an increase in the number of users, the numerical value does not necessarily decreases. Thus, it is possible to enhance the motivation of the user by displaying the indicator, as compared to when a simple user ranking is displayed.

In addition, the one or more processors of the information processing system may be further configured to execute at least one application. A plurality of modes may be set in the application. In this case, in the setting of the ranking, the ranking of the user may be set with respect to each mode. In the calculation of the indicator, the indicator may be calculated with respect to the mode.

Based on the above, it is possible to display the indicator with respect to each mode set in an application.

In addition, even in the same application, the mode may be set to different modes between when a single user executes the application and when a plurality of users execute the application.

Based on the above, it is possible to display the indicator corresponding to the number of users executing the application.

In addition, the information processing system may further include a terminal apparatus and a server. The server may include one or more processors configured to perform the setting of the ranking. The terminal apparatus may include one or more processors configured to: acquire information indicating some of the rankings of the users from the server; and calculate a ranking of a user of the terminal apparatus using the information. In this case, in the calculation of the indicator, the indicator may be calculated for the user of the terminal apparatus using the ranking of the user calculated in the calculation of the ranking of the user.

Based on the above, an apparatus that displays the indicator performs the process of calculating a user ranking and the indicator. This can reduce the processing load of a server.

In addition, the one or more processors of the server may be further configured to at least output, as the information, data representing scores corresponding to some of the rankings. In this case, in the calculation of the ranking of the user, interpolation may be performed based on the information using the scores to be set in rankings other than some of the rankings indicated by the information, and the ranking of the user of the terminal apparatus may be calculated using a result of the interpolation and a score of the user.

Based on the above, the mere acquisition of information regarding some rankings enables the apparatus that displays the indicator to interpolate the user ranking to calculate the indicator.

In addition, the information to be output in the output of the information may include at least data representing scores of users set in a top ranking and a bottom ranking of the rankings.

Based on the above, the use of scores of users set in a top ranking and a bottom ranking enables the interpolation with high accuracy.

In addition, the information processing system may further include a plurality of terminal apparatuses and a server. The server may include one or more processors configured to perform the setting of the ranking. Each of the terminal apparatuses may include one or more processors configured to: output data representing a score of a user of the terminal apparatus to the server; and determine, based on a predetermined condition, whether or not to output the data representing the score of the user of the terminal apparatus to the server. The one or more processors of the server may be further configured to acquire the data representing the score of the user from each of the plurality of terminal apparatuses. In this case, in the setting of the ranking, the ranking may be set using the data representing the score acquired from each of the plurality of terminal apparatuses.

Based on the above, it is possible to transmit data representing scores of users to a server by thinning the data. A terminal apparatus that displays the indicator performs the thinning process. This can reduce the processing load of the server.

In addition, the one or more processors of the server may be further configured to output, to each of the plurality of terminal apparatuses, data representing a condition of the terminal apparatus that is a target from which the data representing the score of the user of the terminal apparatus is acquired. The one or more processors of the terminal apparatus may be further configured to acquire the data representing the condition from the server. In this case, in the determination of the output, it may be determined, using the acquired condition and an identification code uniquely set for the terminal apparatus or the user, whether or not the terminal apparatus is the target.

Based on the above, an acquisition condition is only transmitted to the terminal apparatus that displays the indicator, whereby the terminal apparatus that displays the indicator can easily perform the thinning process.

In addition, in the setting of the ranking, rankings of scores of users set in a top ranking and a bottom ranking in the rankings of the plurality of users and rankings of scores of users set in rankings thinned in a predetermined proportion between the top ranking and the bottom ranking may be set based on superiority or inferiority of the scores of the users. The one or more processors of the information processing system may be further configured to perform interpolation based on the scores in the thinned rankings and the proportion, and based on a result of the interpolation, calculate a ranking of a certain user corresponding to a score of the certain user, and in the calculation of the indicator, the indicator is calculated for the certain user using the ranking of the certain user calculated in the calculation of the ranking of the user.

Based on the above, even using rankings indicating user scores thinned by performing the process of interpolating a user ranking, it is possible to calculate the user ranking and the indicator.

In addition, the one or more processors of the information processing system may be further configured to execute at least one application. In this case, in the calculation of the indicator, in accordance with a score obtained by executing the application during the execution of the application, the indicator may be calculated as needed during the execution. In the display of the indicator, an application image regarding the application may be displayed together with the score obtained during the execution of the application and an image representing the indicator corresponding to the obtained score.

Based on the above, even during the execution of an application, it is possible to display an indicator corresponding to a score gained during the execution of the application.

In addition, the exemplary embodiment may be carried out in the forms of an information processing apparatus, a server, a storage medium having stored therein an information processing program, and an information processing method.

According to the exemplary embodiment, an indicator is displayed such that the higher the ranking, the greater the value of the indicator. This makes it possible to enhance the motivation of a user.

These and other objects, features, aspects and advantages of the exemplary embodiments will become more apparent from the following detailed description of the exemplary embodiments when taken in conjunction with the accompanying drawings.

BRIEF DESCRIPTION OF THE DRAWINGS

FIG. 6 is a diagram showing non-limiting examples of data transmitted and received between the information processing apparatus 3 and the server 200 and thinned score management data managed by the server 200;

DETAILED DESCRIPTION OF NON-LIMITING EXAMPLE EMBODIMENTS

Figure 1:
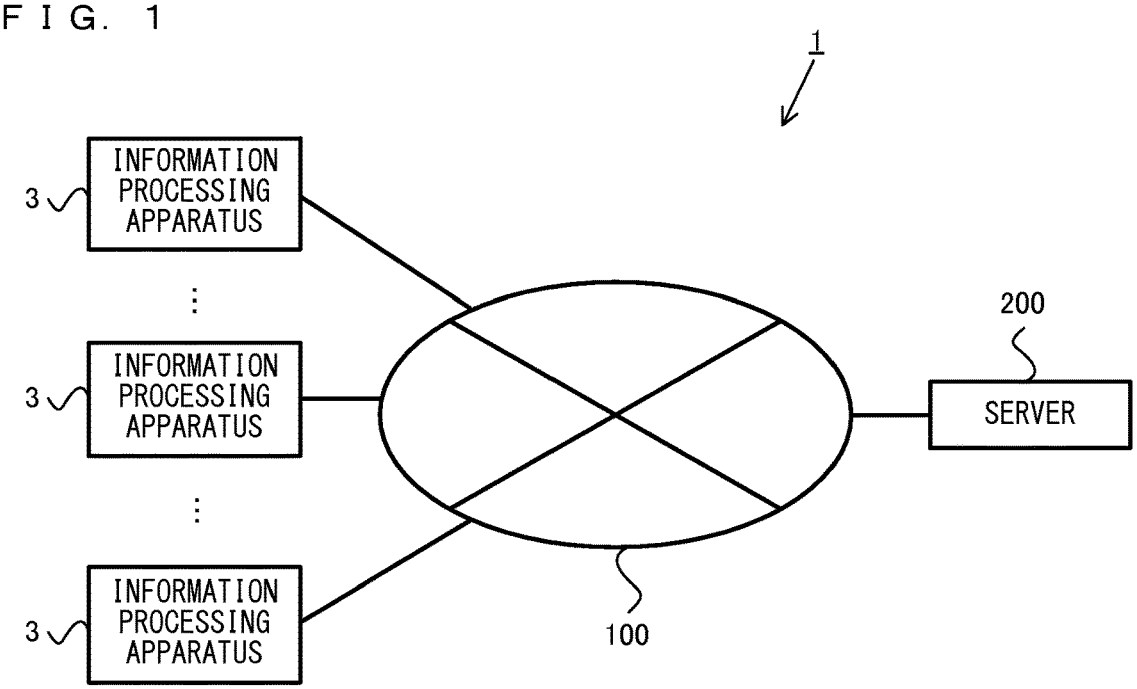
FIG. 1 is a diagram showing a non-limiting example of an information processing system according to an exemplary embodiment.

With reference to FIG. 1, an information processing system according to an exemplary embodiment is described. As shown in FIG. 1, an information processing system 1, which is an example of the information processing system, is constructed by the connections between a plurality of information processing apparatuses 3 and a server 200 via a network 100.

Each information processing apparatus 3 is configured to connect to the network 100 using wireless or wired communication and forms a client/server system with the server 200. For example, the information processing apparatus 3 can execute a predetermined application (e.g., a game application). Further, the information processing apparatus 3 establishes a connection with the server 200 via the network 100 by executing the predetermined application, and thereby can communicate with the server 200. For example, the information processing apparatus 3 can execute an information processing program stored in a storage medium such as an exchangeable memory card or an exchangeable optical disk, or received from another apparatus. The information processing apparatus 3 may be a device such as a general personal computer, a stationary game apparatus, a mobile phone, a handheld game apparatus, or a PDA (Personal Digital Assistant).

Figure 2:
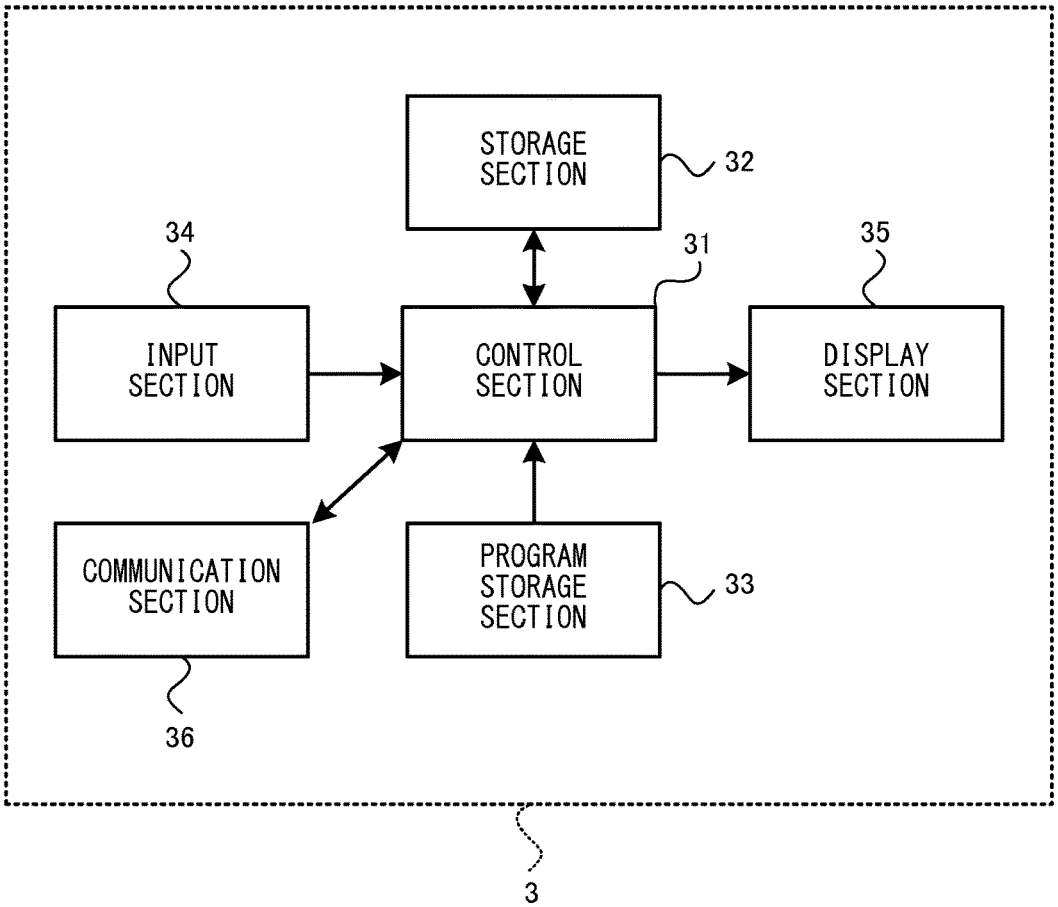
FIG. 2 is a block diagram showing a non-limiting example of the configuration of each information processing apparatus 3 in FIG. 1.

Next, with reference to FIG. 2, the information processing apparatus 3 is described. It should be noted that FIG. 2 is a block diagram showing an example of the configuration of the information processing apparatus 3. In FIG. 2, the information processing apparatus 3 includes a control section 31, a storage section 32, a program storage section 33, an input section 34, a display section 35, and a communication section 36. It should be noted that the information processing apparatus 3 may be composed of one or more apparatuses including: an information processing apparatus having at least the control section 31; and another apparatus.

The control section 31 is information processing means (a computer) for performing various types of information processing, and is, for example, a CPU. For example, the control section 31 has the functions of executing the application to perform game processing described later, the process of calculating a user ranking, the process of calculating world ranking points, data transmission/reception process via the server 200, and the like, as the various types of information processing. For example, the above functions of the control section 31 are achieved, for example, by the CPU executing a predetermined program.

The storage section 32 stores various pieces of data used when the control section 31 performs the above information processing. The storage section 32 is, for example, a memory accessible by the CPU (the control section 31).

The program storage section 33 stores a program. The program storage section 33 may be any storage device (storage medium) accessible by the control section 31. For example, the program storage section 33 may be a storage device provided in the information processing apparatus having the control section 31, or may be a storage medium detachably attached to the information processing apparatus having the control section 31. Alternatively, the program storage section 33 may be a storage device (a server or the like) connected to the control section 31 via a network. The control section 31 (the CPU) may read part or all of a game program to the storage section 32 at appropriate timing and execute the read program.

The input section 34 is an input apparatus that can be operated (subjected to a character input operation performed) by a user. The input section 34 may be any input apparatus.

The display section 35 displays an image in accordance with an instruction from the control section 31. It should be noted that if the information processing apparatus 3 is composed of a stationary game apparatus or a personal computer, the display section 35 may be composed separately from the information processing apparatus 3.

The communication section 36 is composed of a predetermined communication module. The communication section 36 transmits and receives data to and from another device (e.g., the server 200) via the network 100, and transmits and receives data to and from the other information processing apparatuses 3.

Figure 3:
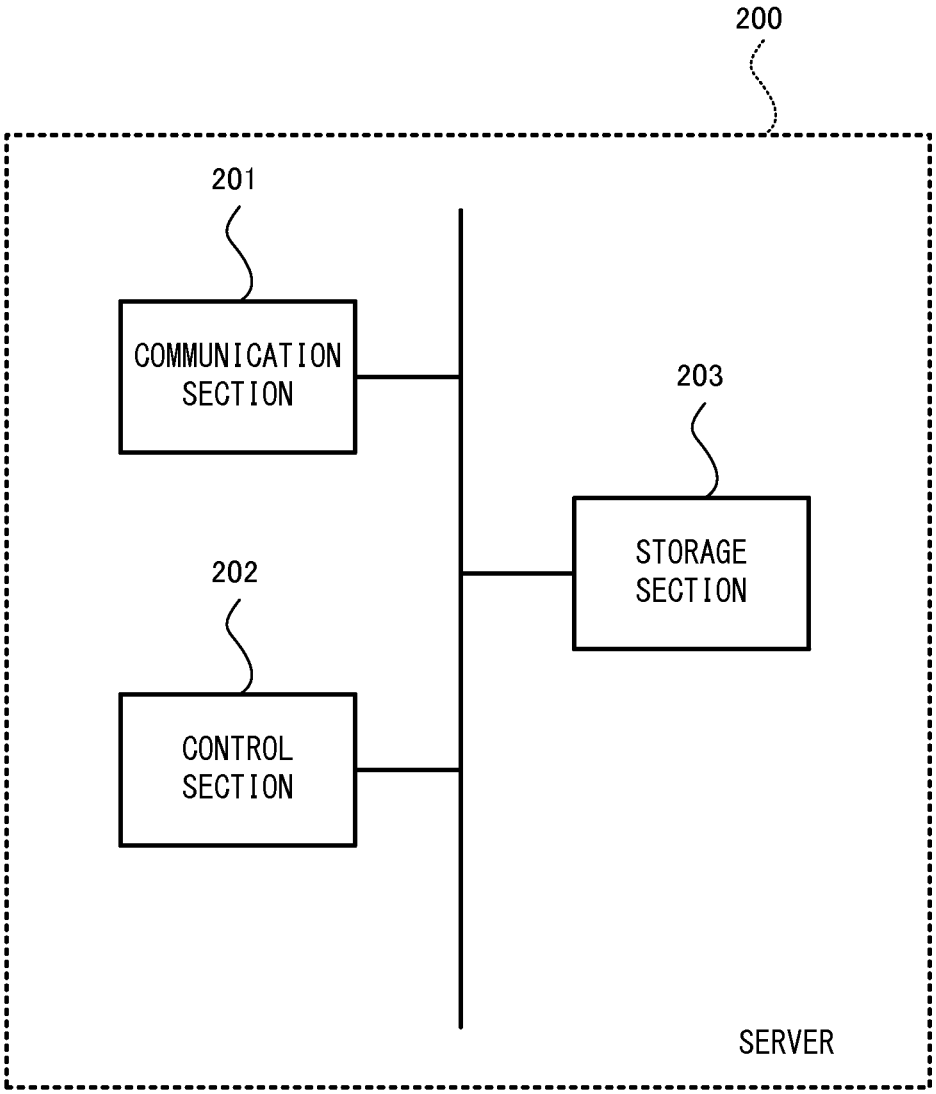
FIG. 3 is a block diagram showing a non-limiting example of the configuration of a server 200 in FIG. 1.

Next, with reference to FIG. 3, the server 200 is described. It should be noted that FIG. 3 is a block diagram showing an example of the configuration of the server 200.

The server 200 includes a communication section 201, a control section 202, and a storage section 203. The communication section 201 transmits and receives communication packets, thereby communicating with the plurality of information processing apparatuses 3 and the like via the network 100. The control section 202 performs: the process of managing game score data transmitted from each information processing apparatus 3; the process of transmitting ranking distribution data based on data regarding the management; and the process of notifying each information processing apparatus 3 of the proportion (the thinning rate) of information processing apparatuses 3 of which the pieces of game score data are to be output. The control section 202 also establishes communication links to the information processing apparatuses 3 and the like via the communication section 201, thereby controlling data transmission and selecting a path in the network 100. The storage section 203 stores: a program to be executed by the control section 202; various pieces of data necessary for the above processes; various pieces of data necessary for communication with the information processing apparatuses 3; and the like. It should be noted that, if the system requires a predetermined login process for data transmission and reception using the network 100, the system may perform an authentication process for determining whether or not a user attempting to log in to the server 200 is an authorized user. Further, the server 200 may be composed of a single server machine, or may be composed of a plurality of server machines.

Figure 4:
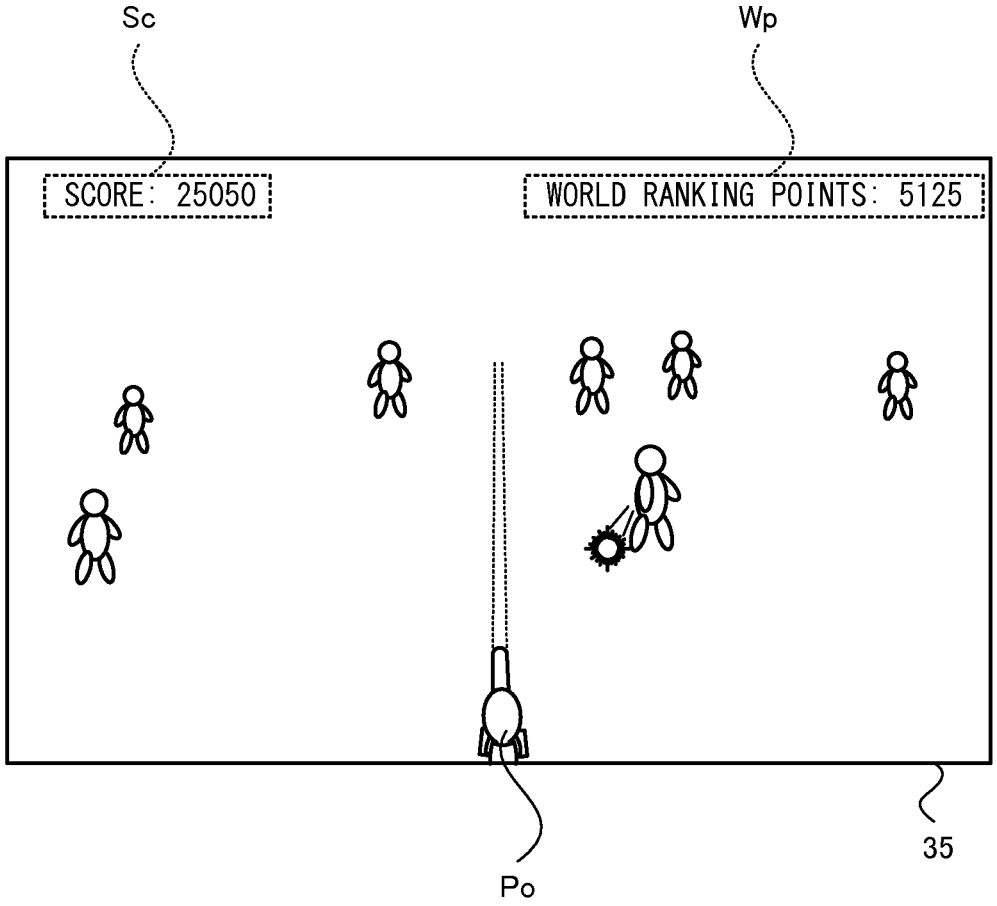
FIG. 4 is a diagram showing a non-limiting example of an image displayed on a display section 35 of the information processing apparatus 3.
Figure 5:
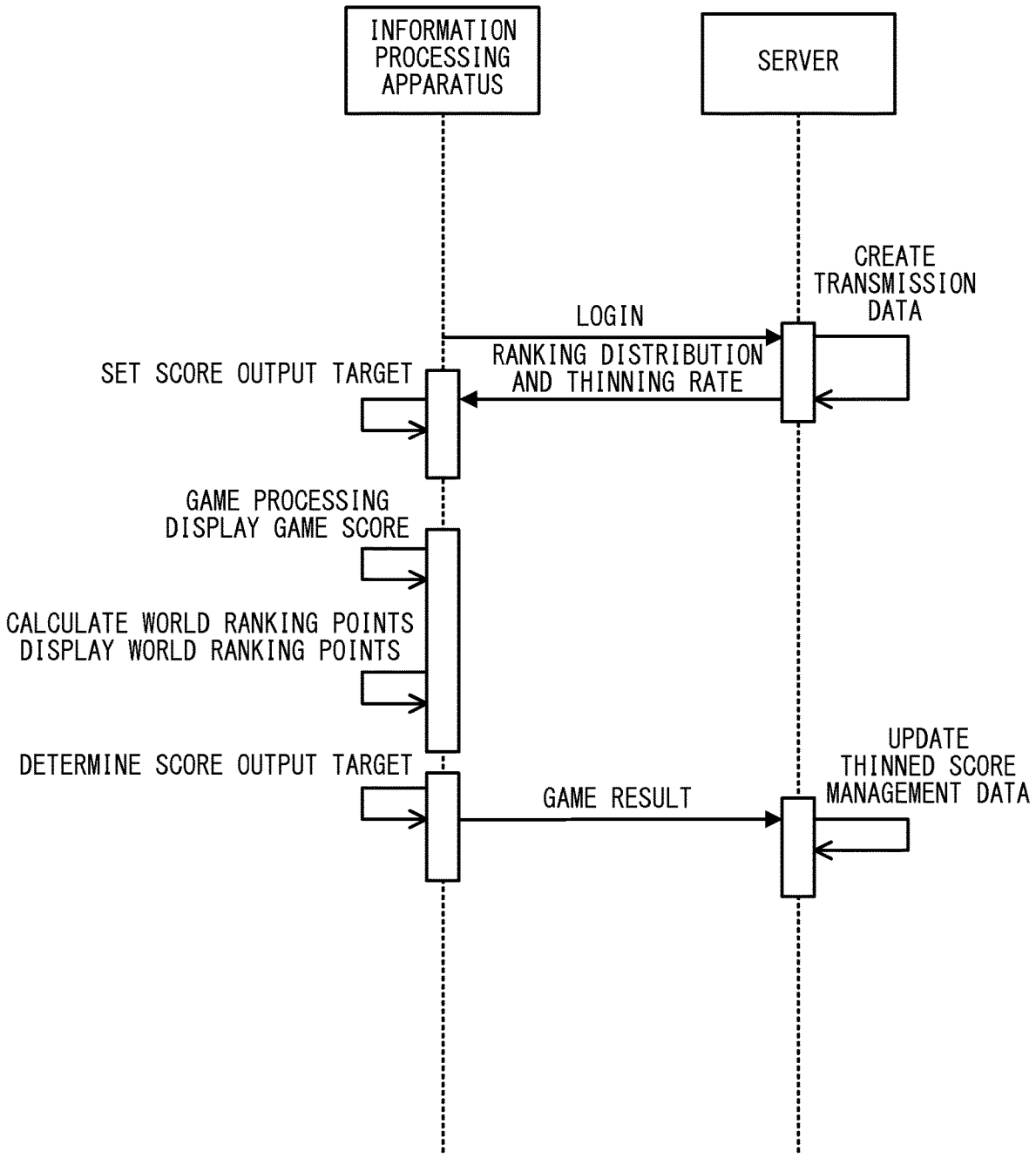
FIG. 5 is a chronological diagram showing a non-limiting example of the interaction between apparatuses when world ranking points are displayed in an information processing system 1.
Figure 7:
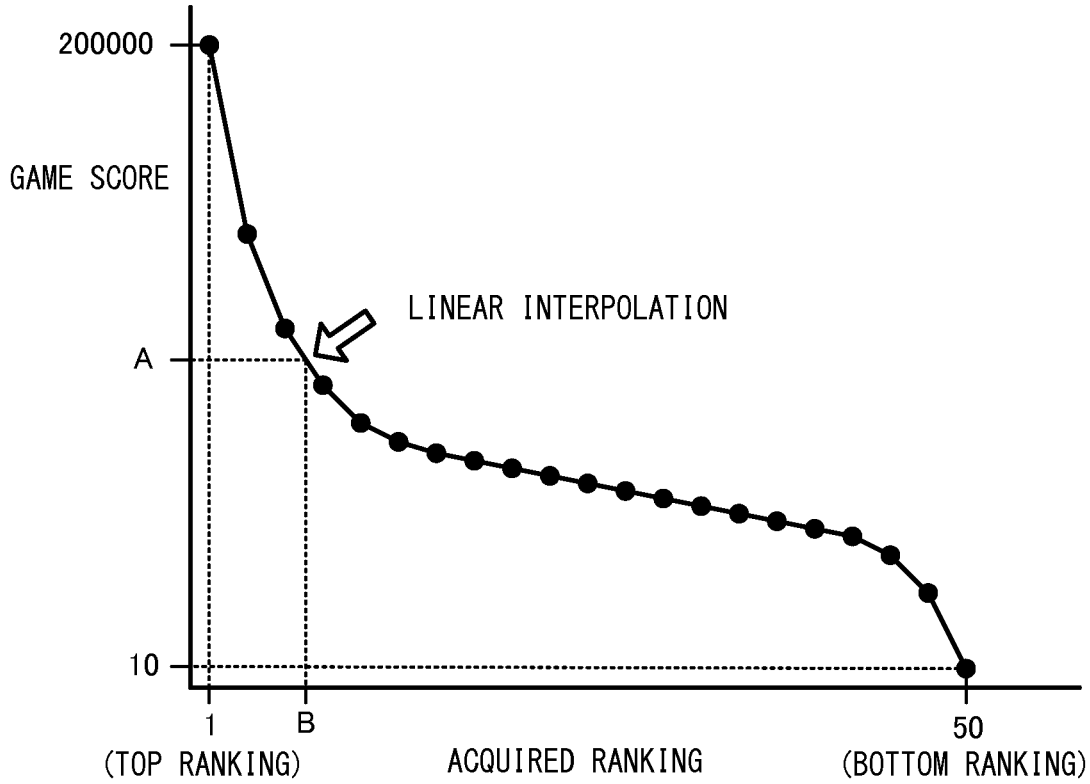
FIG. 7 is a diagram showing a non-limiting example where in the information processing apparatus 3, the ranking of a user of the information processing apparatus 3 itself is estimated to calculate world ranking points.
Figure 7:
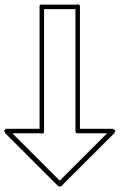

Next, with reference to FIGS. 4 to 7, a description is given of an overview of the processing performed by the information processing system 1, before the description of specific processing performed by the information processing apparatuses 3 and the server 200. It should be noted that FIG. 4 is a diagram showing an example of an image displayed on the display section 35 of each information processing apparatus 3. FIG. 5 is a chronological diagram showing an example of the interaction between apparatuses when world ranking points are displayed in the information processing system 1. FIG. 6 is a diagram showing examples of data transmitted and received between the information processing apparatus 3 and the server 200 and thinned score management data managed by the server 200. FIG. 7 is a diagram showing an example where in the information processing apparatus 3, the ranking of a user of the information processing apparatus 3 itself is estimated to calculate world ranking points. It should be noted that the following descriptions are given using a game as an example of the application to be executed by the information processing apparatus 3. Alternatively, another application may be executed by the information processing apparatus 3.

In FIG. 4, on the display section 35 of the information processing apparatus 3, a game image is displayed that corresponds to a game that is being played using the information processing apparatus 3. As an example, a scene in a versus game is displayed where a player object Po competes against enemy characters. Then, on the display section 35, a score (game score) Sc and world ranking points Wp at the current moment in the versus game are displayed.

For example, the score Sc is a score gained in the game that is being played. If an enemy character has been defeated or an item has been obtained, predetermined points are added to the score Sc. The world ranking points Wp are calculated based on the ranking of a user in the game that is being played by the user. Specifically, using a total number T of users participating in a list of rankings of the game that is being played by the user and a ranking Ru of the user themselves in the list of rankings, the world ranking points Wp are calculated by $$WP=T-Ru+1$$

For example, if the total number T of users participating in the list of rankings is 500000 and the ranking Ru of the user in the list of rankings is 1200th, the world ranking points Wp are $$WP=500000-1200+1=498801$$

As described above, the world ranking points Wp are such that the higher the ranking of the user themselves, the greater the numerical value. Then, even in the same ranking, the numerical value of the world ranking points Wp increases as the total number T of users participating in the list of rankings increases. Thus, even if the number of users becomes enormous and the ranking of the user falls relatively, the numerical value does not necessarily decrease. Thus, it is possible to enhance the motivation of the user by displaying the world ranking points Wp, as compared to when a simple ranking is displayed.

As an example, the world ranking points Wp are displayed based on the ranking of the user themselves with respect to the highest score in the game. In this case, based on the highest score in the previously played game, the world ranking points Wp may be displayed during at least some period between before the start of the game and after the end of the game. As another example, the world ranking points Wp are displayed based on an intermediate score while the user themselves is performing the game. In this case, a ranking corresponding to the intermediate score when the game is ended while maintaining the intermediate score is calculated, and the world ranking points Wp calculated based on the calculated ranking are displayed during the game. It should be noted that if the world ranking points Wp are displayed during the game, the world ranking points Wp may be displayed in real time in conjunction with an increase and/or a decrease in the game score, or the world ranking points Wp may be displayed by calculating the world ranking points Wp at predetermined time intervals.

In addition, the world ranking points Wp may be calculated with respect to each mode set for a condition for completing the game. For example, the mode of the game is set for each level of difficulty for completing the game, which can be set by the user, or is set for each mini-game set in the game, or is set for each condition of a player object for completing the game (a condition for restoring life, the limitations on an item to be owned and a move that can be used, and the like), or is set for each opponent character that appears in the game, or is set based on whether the game is played by a single user or a plurality of users. In this case, the list of rankings is also set with respect to each mode, the ranking of the user is also determined with respect to the mode, and the world ranking points Wp are also calculated with respect to the mode.

The game score of each user participating in the game is managed by the server 200. For example, as shown in FIG. 5, to request user ranking distribution information, the user of the information processing apparatus 3 participating in the list of rankings performs the operation of logging in to the server 200. In accordance with the operation, the information processing apparatus 3 transmits a user ID indicating the user of the information processing apparatus 3 to the server 200. The user ID may only need to be a unique code that enables the identification of the user, and may be, for example, an account ID, which is a character string serving as an indicator for identifying the user.

If the information processing apparatus 3 has made a login request, the server 200 determines whether or not the user attempting to log in is an authorized user. For example, the server 200 manages the user IDs of users of the network 100 and authenticates the user attempting to log in to the server 200 using any of the user IDs. It should be noted that to authenticate the user, the server 200 may further use a password and the device ID of the information processing apparatus 3 used for the login. In this case, the information processing apparatus 3 having made the login request transmits the user ID together with password data and the device ID to the server 200.

As shown in FIG. 6, the server 200 manages a list of game score rankings with respect to each mode of the game. Here, the list of game score rankings managed by the server 200 is managed based on data thinned at a predetermined thinning rate (thinned score management data). In the example of FIG. 6, game scores in the first (top) ranking to an Nth (bottom) ranking are arranged and described in order of superiority in thinned game score. It should be noted that in the example of FIG. 6, the higher the game score, the more excellent the game result. Thus, the thinned game scores are managed such that the game scores are arranged in descending order relative to the thinned rankings arranged in ascending order. Here, the thinned rankings indicate rankings corresponding to the number of pieces of data (N pieces of data in the example of FIG. 6) with respect to each mode managed by the server 200. For example, in the example of FIG. 6, the server 200 manages N pieces of data for a certain mode. Thus, the top ranking is the first thinned ranking, and the bottom ranking is the Nth thinned ranking.

If the login has been permitted, the server 200 creates transmission data including ranking distribution data and thinning rate data and transmits the created transmission data to the information processing apparatus 3 having logged in. For example, the server 200 transmits, among pieces of data of the game scores managed in the thinned score management data, a predetermined number of pieces of data (e.g., pieces of data describing 50 game scores) as ranking distribution data to the information processing apparatus 3. Specifically, the ranking distribution data to be transmitted to the information processing apparatus 3 includes pieces of data representing the game score in the top ranking, the game score in the bottom ranking, and game scores determined in rankings extracted between the top ranking and the bottom ranking at ranking intervals based on a predetermined proportion (a proportion for obtaining the number (e.g., a total of 50) of pieces of data to be transmitted). Further, the ranking distribution data also includes data representing the thinned ranking managed as the bottom ranking (a ranking N in the example of FIG. 6). It should be noted that a mode (game) that is a transmission target for which the ranking distribution data is transmitted may be all the modes managed by the server 200, or may be some modes corresponding to a request from the information processing apparatus 3. In the second case, the information processing apparatus 3 may notify the server 200 of mode types (game types) that are transmission targets, and the server 200 may transmit ranking distribution data corresponding to the notification.

The thinning rate data to be transmitted to the information processing apparatus 3 is data representing the proportion of information processing apparatuses 3 that are targets that transmit pieces of data representing the user scores to the server 200. For example, if a numerical value of 100 has been set as the thinning rate data, information processing apparatuses 3, at the rate of one in 100, transmit pieces of data representing the user scores to the server 200. It should be noted that the process in which each information processing apparatus 3 transmits user score data will be described later.

It should be noted that in the above description, an example has been used where the ranking distribution data to be transmitted to the information processing apparatus 3 having logged in includes data representing the thinned ranking managed as the bottom ranking by the server 200. Alternatively, the ranking distribution data may include data representing another ranking, instead of this data. For example, as will be apparent later, the estimated ranking of each piece of data calculated by multiplying by a thinning rate the thinned ranking of each of a predetermined number of (50 in the example of FIG. 6) pieces of data including the top ranking and the bottom ranking (provided that the top ranking remains 1) may be included in the ranking distribution data.

Having received the ranking distribution data and the thinning rate data, the information processing apparatus 3 determines, using the numerical value (the thinning rate) represented by the thinning rate data, whether or not the information processing apparatus 3 itself is a target (a score output target) that outputs user score data. For example, the information processing apparatus 3 calculates the remainder obtained by dividing the unique user ID, which enables the identification of the user (e.g., the account ID, which is a character string serving as an indicator for identifying the user), by the numerical value represented by the thinning rate data. Then, if a value uniquely set in advance for each game mode (e.g., a mode ID set in advance using 0 or a positive consecutive integer after 1) matches the calculated remainder, it is determined that the user operating the information processing apparatus 3 is a score output target. It should be noted that if the number of the mode ID is greater than the numerical value indicating the thinning rate (e.g., the thinning rate is 100, the number of the mode ID is greater than 100, and 101 or more mode IDs are set) and if the remainder obtained by dividing the user ID (the account ID) by the numerical value represented by the thinning rate data matches the remainder obtained by dividing the mode ID by the numerical value, it may be determined that the user operating the information processing apparatus 3 is a score output target.

It should be noted that the information processing apparatus 3 may determine, using the device ID set for the information processing apparatus 3, whether or not the information processing apparatus 3 itself is a score output target. In this case, the information processing apparatus 3 calculates the remainder obtained by dividing the device ID of the information processing apparatus 3 itself by the numerical value represented by the thinning rate data. If a value uniquely set in advance for each game mode matches the calculated remainder, it is determined that the information processing apparatus 3 itself is a score output target.

After having logged in and set the score output target, the information processing apparatus 3 starts a game and displays on the display section 35 the game score (score) gained in the game. Then, the information processing apparatus 3 calculates world ranking points in accordance with an increase and/or a decrease in the gained score and displays the calculated world ranking points on the display section 35 during the game.

As shown in FIG. 7, using the ranking distribution data acquired at the time of the login, the information processing apparatus 3 calculates the ranking of the user of the information processing apparatus 3 itself in a list of rankings set for the mode in which the game is being played. For example, the information processing apparatus 3 sets the relationships between the game scores represented by the ranking distribution data and the rankings (acquired rankings) of the game scores arranged in order of superiority. For example, if 50 game scores have been acquired, the acquired game scores are arranged in order of superiority, and acquired rankings of 1 to 50 are assigned to the game scores, thereby setting the relationships between the game scores and the acquired rankings. Specifically, as shown in FIG. 7, the first acquired ranking is assigned to a game score of 200000 in the top ranking. The fiftieth acquired ranking is assigned to a game score of 10 in the bottom ranking. Then, the relationships between the game scores and the acquired rankings are set as in a graph where the game scores (points shown in a graph in FIG. 7) in the first to fiftieth acquired rankings are sequentially connected together by straight lines.

The information processing apparatus 3 calculates an acquired ranking corresponding to a score gained at the current moment. For example, as shown in FIG. 7, if a game score A, which does not match any of the game scores in the first to fiftieth acquired rankings, has been gained, linear interpolation is performed using the game scores immediately above and below the game score A, thereby calculating an acquired ranking B, which corresponds to the game score A. Next, the information processing apparatus 3 calculates a user ranking corresponding to the acquired ranking B (the ranking of the user in the list of rankings) based on the bottom thinned ranking (the ranking N) represented by the ranking distribution data acquired at the time of the login, the total acquisition number (e.g., 50) of the acquired game scores, and the numerical value (the thinning rate; e.g., 100) represented by the thinning rate data. For example, the user ranking is calculated by $$\text{user ranking} = B * \text{thinning rate} * (N/\text{total acquisition number})$$

It should be noted that the method of interpolating an acquired ranking using the game scores immediately above and below the gained game score may not be linear interpolation. Alternatively, for example, a correlation function may be calculated using all the points at which the game scores have been acquired, and an acquired ranking may be interpolated using the correlation function. Yet alternatively, interpolation based on another interpolation function such as a quadratic function, a high-dimensional function, a sine function, or a cosine function may be used.

It should be noted that as described above, if the received ranking distribution data includes the estimated rankings of pieces of data, a ranking corresponding to the game score A may be calculated using the estimated rankings. In this case, linear interpolation is performed using the game scores immediately above and below the game score A, thereby calculating the user ranking corresponding to the game score A from the estimated rankings of the game scores immediately above and below the game score A.

Then, the information processing apparatus 3 calculates world ranking points using the total number of users participating in the list of rankings and the user ranking. Here, the information processing apparatus 3 estimates the total number of users participating in the list of rankings using the bottom thinned ranking (the ranking N) represented by the ranking distribution data acquired at the time of the login and the numerical value (the thinning rate) represented by the thinning rate data. Specifically, the total number of users is calculated by $$\text{total number of users} = N * \text{thinning rate}$$

Then, world ranking points are calculated by $$\text{world ranking points} = \text{total number of users} - \text{user ranking} + 1 = N * \text{thinning rate} - \text{user ranking} + 1$$

It should be noted that if the received ranking distribution data includes data representing the total number of users (or the estimated ranking of data in the bottom ranking), the information processing apparatus 3 may calculate world ranking points using the acquired data, without calculating the total number of users.

It should be noted that the addition of 1 in the calculation of world ranking points changes the points of the user in the bottom ranking to 1. If, however, the points of the user in the bottom ranking are set to 0, it is not necessary to add 1. Further, world ranking points are calculated by subtracting the user ranking from the total number of users. Alternatively, world ranking points may be calculated by another calculation method using the total number of users and the user ranking. As an example, world ranking points may be calculated based on a numerical value obtained by dividing the total number of users by the user ranking. As another example, as world ranking points, a numerical value obtained by multiplying by any coefficient a numerical value obtained by subtracting the user ranking from the total number of users, or a numerical value obtained by dividing the total number of users by the user ranking, may be calculated.

If the game has ended, the information processing apparatus 3 determines whether or not to transmit the result of the game to the server 200. For example, if the highest score of the user themselves has been updated in the game having ended and it has been determined that the information processing apparatus 3 itself has been a score output target at the time of the login, the information processing apparatus 3 transmits, to the server 200, type data representing the type of the mode (the type of the game) in which the highest score has been updated, together with data representing the score gained in the game having ended. Further, if a game result has been obtained that updates the game score in the top ranking represented by the ranking distribution data acquired at the time of the login, the information processing apparatus 3, even if the information processing apparatus 3 itself is not set as a score output target, transmits to the server 200 the type data together with data representing the score gained in the game having ended.

If the server 200 has received data representing the game score, the server 200 adds the game score represented by the received data to thinned score management data corresponding to the type of the mode (the type of the game) represented by the received data, such that the added game score is at a position corresponding to the superiority or inferiority of the game score. Then, the server 200 describes the added game score, thereby updating the thinned score management data.

As described above, the server 200 only transmits data representing a thinning rate to each information processing apparatus 3, and thereby can acquire as many game results corresponding to the thinning rate. That is, the information processing apparatus 3 performs the process of determining whether or not the user operating the information processing apparatus 3 is a score output target. This can reduce the processing load of the server 200 performing this process. Further, data managed by the server 200 is data thinned in accordance with the thinning rate. This can reduce data to be managed by the server 200. Further, the ranking distribution data to be transmitted from the server 200 to each information processing apparatus 3 is data representing a predetermined number of user scores. Thus, even if the number of thinned user scores exceeds the predetermined number, it is possible to limit the amount of data to be transmitted. Further, the information processing apparatus 3 also performs the process of interpolating an acquired ranking to calculate a user ranking. This can reduce the processing load of the server 200 performing this process.

It should be noted that the above thinning rate may be changed in accordance with the total number of pieces of user score data managed by the server 200 or the like. For example, an initial thinning rate may be set to 1, and the thinning rate may be changed to increase in accordance with an increase in the total number of pieces of user score data.

In addition, the server 200 may notify each information processing apparatus 3 of score output targets by a method other than the method of notifying the information processing apparatus 3 of a thinning rate. As a first example, the server 200 may directly notify each information processing apparatus 3 of the device IDs or the user IDs (the account IDs) of information processing apparatuses 3 to be set as score output targets. As an example, the server 200 may specify the numerical value of the last two digits of device IDs or user IDs (account IDs) or the like, thereby directly indicating information processing apparatus 3 or users to be set as score output targets. As a second example, in accordance with the timing when an information processing apparatus 3 has logged in, the server 200 determines whether or not the information processing apparatus 3 is to be set as a score output target. Then, if the information processing apparatus 3 is to be set as a score output target, the server 200 may transmit data indicating this to the information processing apparatus 3. As an example, the server 200 may count the number of times each information processing apparatus 3 has logged in to the server 200, and if the number of logins has reached a predetermined count value (e.g., a count value obtained at predetermined intervals), the user of the information processing apparatus 3 having performed these logins may be set as a score output target. As a third example, in accordance with the circumstances of an information processing apparatus 3 having logged in, the server 200 determines whether or not the information processing apparatus 3 is to be set as a score output target. Then, if the information processing apparatus 3 is to be set as a score output target, the server 200 may transmit data indicating this to the information processing apparatus 3. As an example, in accordance with whether or not the game score data of the user of the information processing apparatus 3 having logged in has already been acquired, or in accordance with the numerical value of the highest score of the user of the information processing apparatus 3 having logged in, the server 200 determines whether or not the user of the information processing apparatus 3 is to be set as a score output target.

In addition, user score data managed by the server 200 is data thinned in accordance with the thinning rate and therefore can reduce data managed by the server 200. If, however, such an effect is not desired, user score data may be managed by the server 200 without thinning the user score data. In this case, if the highest score of each user has been updated, the server 200 receives all the pieces of user score data indicating the highest scores. This makes it possible to manage the highest scores of all the users participating in a list of rankings.

In addition, the ranking distribution data to be transmitted from the server 200 to each information processing apparatus 3 is data representing a predetermined number of user scores. This can reduce the amount of data to be transmitted and the processing load of the information processing apparatus 3. If, however, such an effect is not desired, data representing all the user scores managed by the server 200 may be transmitted as the ranking distribution data. In this case, the server 200 does not need to perform the process of selecting pieces of user score data to be transmitted. Further, if this form is combined with the above form in which the server 200 manages user score data without thinning the user score data, the information processing apparatus 3 does not need to perform the process of interpolating a user ranking.

In addition, if the effect of reducing the processing performed by the server 200 is not desired, the server 200 may perform at least part of the processing performed by the information processing apparatus 3. For example, the information processing apparatus 3 transmits data representing a game score, thereby enabling the server 200 to perform at least some of the process of interpolating a user ranking, the process of calculating a user ranking, the process of calculating world ranking points, and the like.

In addition, in the information processing system 1 described above, data is transmitted and received via the server 200. Alternatively, the server 200 may be composed of a single server machine, or may be composed of a plurality of server machines. If the server 200 is composed of a plurality of server machines, each server machine may share the above functions.

Figure 8:
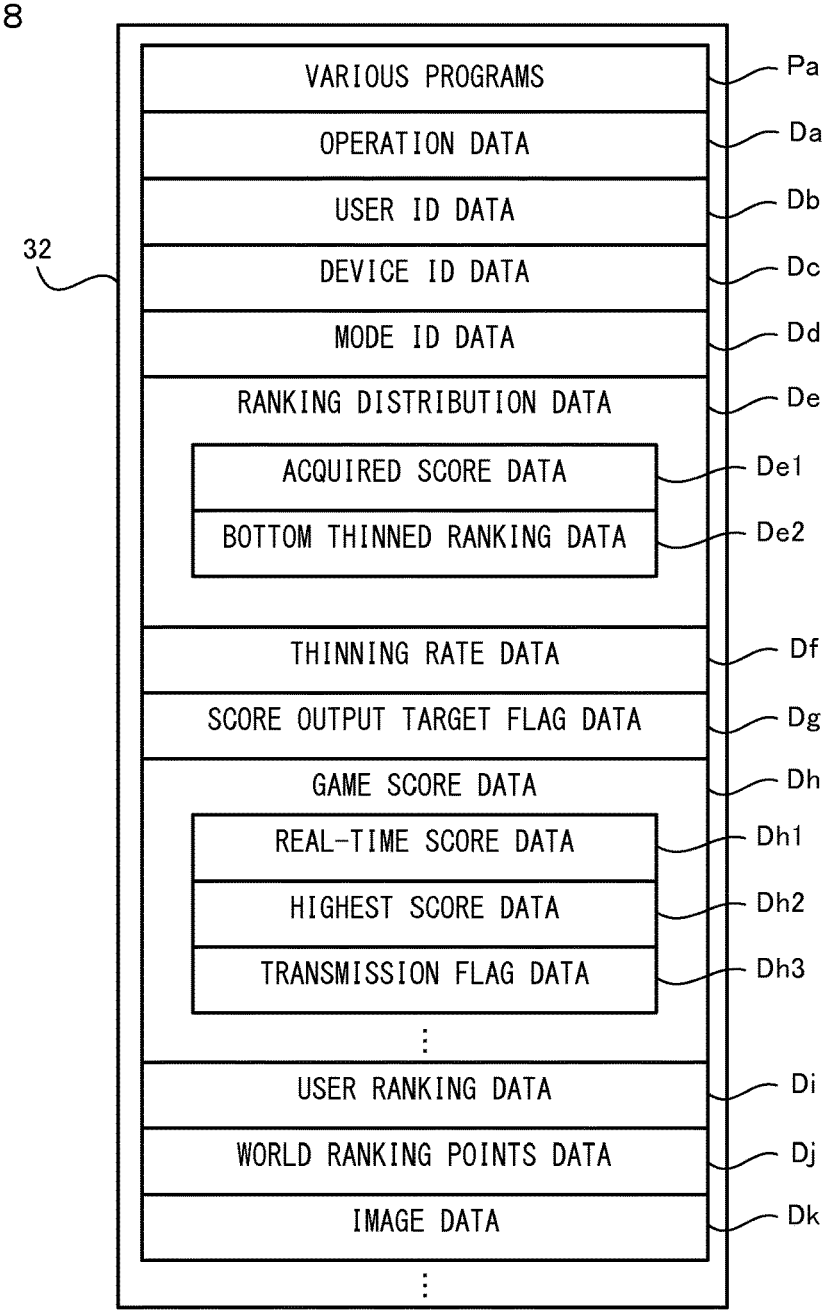
FIG. 8 is a diagram showing non-limiting examples of main data and programs stored in a storage section 32 of the information processing apparatus 3.
Figure 9:
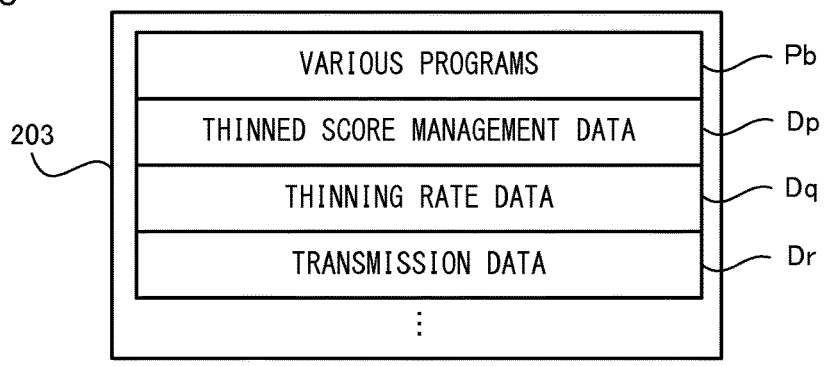
FIG. 9 is a diagram showing non-limiting examples of main data and programs stored in a storage section 203 of the server 200.

Next, a detailed description is given of the processing performed by the information processing system 1. First, with reference to FIGS. 8 and 9, main data used in the processing is described. It should be noted that FIG. 8 is a diagram showing examples of main data and programs stored in the storage section 32 of each information processing apparatus 3. FIG. 9 is a diagram showing examples of main data and programs stored in the storage section 203 of the server 200.

As shown in FIG. 8, the following are stored in the data storage area of the storage section 32: operation data Da; user ID data Db; device ID data Dc; mode ID data Dd; ranking distribution data De; thinning rate data Df; score output target flag data Dg; game score data Dh; user ranking data Di; world ranking points data Dj; image data Dk; and the like. It should be noted that the storage section 32 stores, as well as the data included in the information shown in FIG. 8, data and the like necessary for the processing, such as data used in an application to be executed. Further, in the program storage area of the storage section 32, various programs Pa included in the information processing program are stored.

The operation data Da is data representing operation information of the operation performed on the information processing apparatus 3 by the user. For example, operation data indicating the operation performed on an operation button or the like is acquired per time unit that the information processing apparatus 3 performs processing (e.g., every 1/60 second), and the operation data is stored and updated in the operation data Da in accordance with the acquisition.

The user ID data Db is data representing a unique code (a user ID) that enables the identification of the user who uses the information processing apparatus 3, and is data representing, for example, an account ID, which is a character string serving as an indicator for the identification of the user.

The device ID data Dc is data representing a unique code (a device ID) that enables the identification of the information processing apparatus 3, and is data representing, for example, an unalterable character string serving as an indicator for the identification of the device. The device ID data Dc stores the device ID set in advance for the information processing apparatus 3.

The mode ID data Dd is data representing a value (a mode ID) uniquely set in advance for each game mode that can be played using the information processing apparatus 3.

The ranking distribution data De is acquired from the server 200, stored, and managed with respect to each mode (each game). The ranking distribution data De includes acquired score data De1 and bottom thinned ranking data De2. The acquired score data De1 is data representing a predetermined number of (e.g., 50) game scores that have been extracted from game scores managed in thinned score management data and have been transmitted from the server 200. The bottom thinned ranking data De2 is data representing a thinned ranking managed as the bottom ranking (e.g., the ranking N in FIG. 6) in the thinned score management data.

The thinning rate data Df is data representing a thinning rate transmitted from the server 200 and stored.

The score output target flag data Dg is data representing a score output target flag indicating whether or not the user of the information processing apparatus 3 itself is a score output target. If the user of the information processing apparatus 3 itself is a score output target, the score output target flag is set to on. It should be noted that if it is determined whether or not the user of the information processing apparatus 3 itself is a score output target for all the game modes that can be played using the information processing apparatus 3, the score output target flag is also set with respect to each game mode.

The game score data Dh is data representing the score (the game score) of a game that is being played using the information processing apparatus 3 itself. The game score data Dh is managed with respect to each game mode that can be played using the information processing apparatus 3. The game score data Dh includes real-time score data Dh1, highest score data Dh2, and transmission flag data Dg3. The real-time score data Dh1 is data representing the score (the game score) gained in a game that is being played using the information processing apparatus 3. The highest score data Dh2 is data representing the highest score of the user in a played game. The transmission flag data Dg3 is data representing a transmission flag that is set to on if the user score data represented by the highest score data Dh2 is a target to be transmitted to the server 200.

The user ranking data Di is data representing a user ranking calculated in accordance with the score of the user. The world ranking points data Dj is data representing world ranking points calculated in accordance with a user ranking.

The image data Dk is data for generating a game image in which an object, a character, a background, and the like are placed, and displaying the image on the display section 35.

As shown in FIG. 9, the following are stored in the data storage area of the storage section 203: thinned score management data Dp; thinning rate data Dq; transmission data Dr; and the like. It should be noted that the storage section 203 may store, as well as the data included in the information shown in FIG. 9, data and the like necessary for the processing performed by the server 200 (e.g., processes regarding a login, data management, and data transmission). Further, in the program storage area of the storage section 203, various programs Pb for achieving the above processing are stored.

The thinned score management data Dp is data representing a list of game score rankings (thinned score management data; see FIG. 6) managed with respect to each mode (each game) that can be played using each information processing apparatus 3.

The thinning rate data Dq is data representing the proportion of information processing apparatuses 3 that are targets that transmit pieces of data representing user scores.

The transmission data Dr is data representing transmission data to be transmitted to each information processing apparatus 3.

Figure 10:
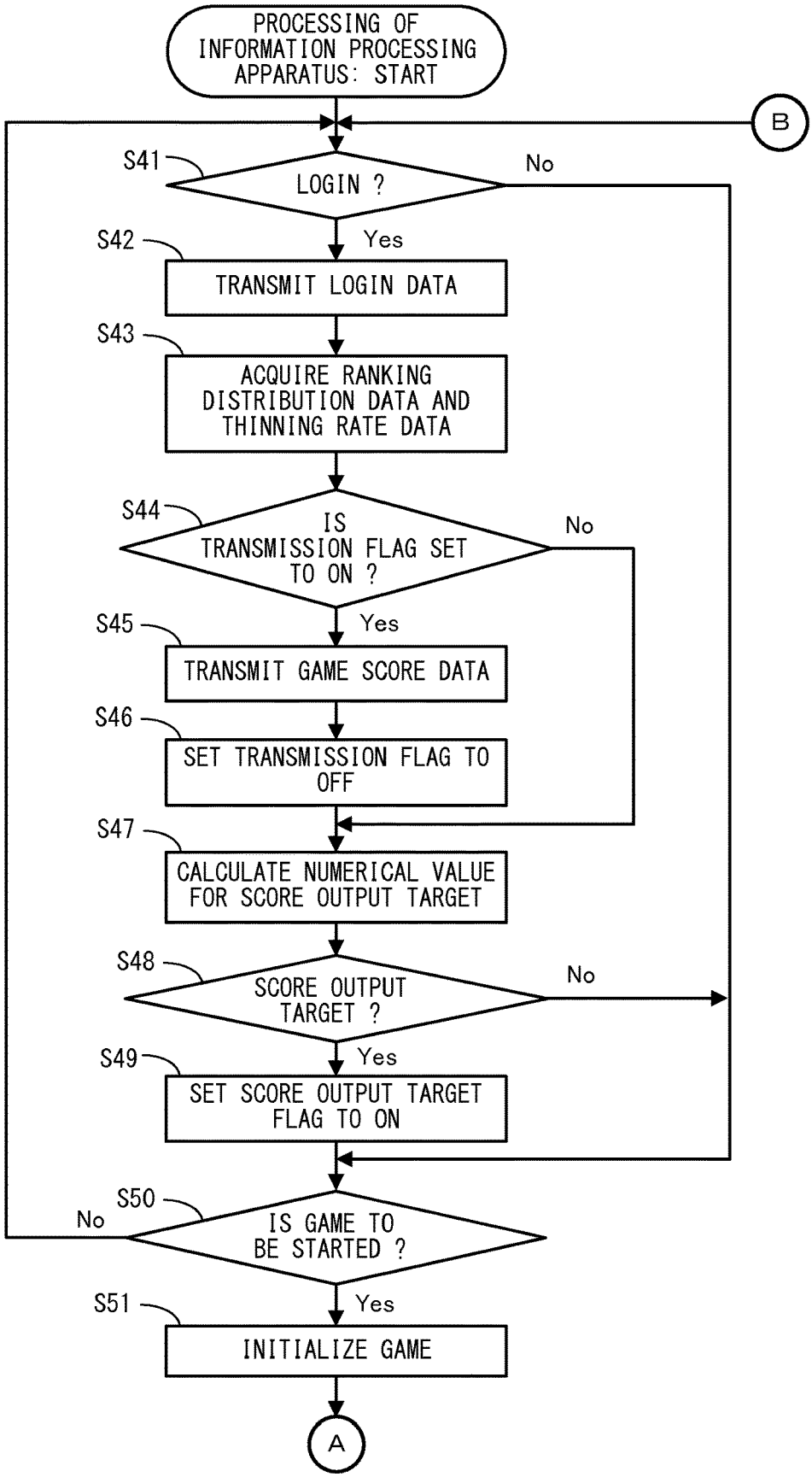
FIG. 10 is a flow chart showing a non-limiting example of the processing performed by the information processing apparatus 3.
Figure 11:
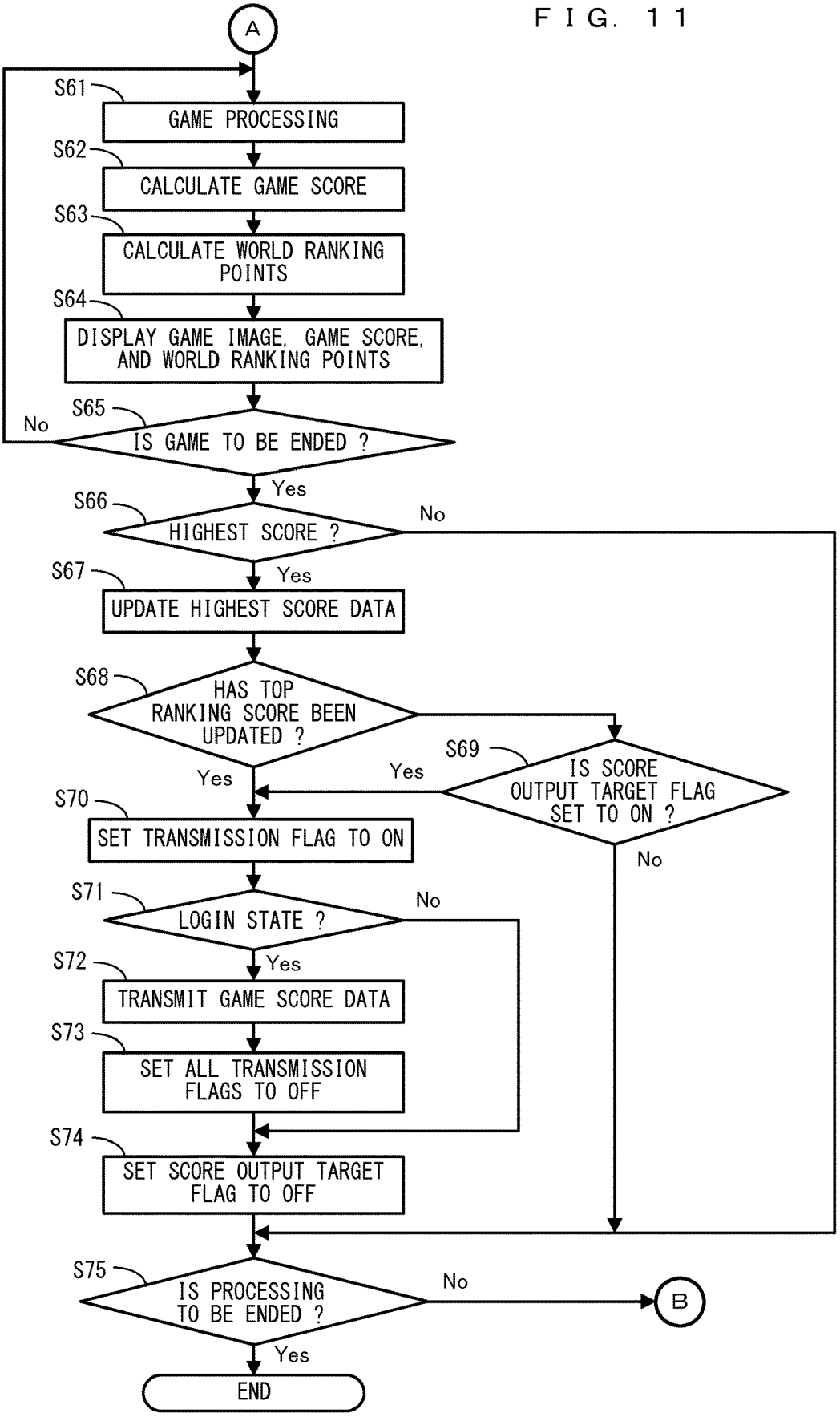
FIG. 11 is a flow chart showing a non-limiting example of the processing performed by the information processing apparatus 3.
Figure 12:
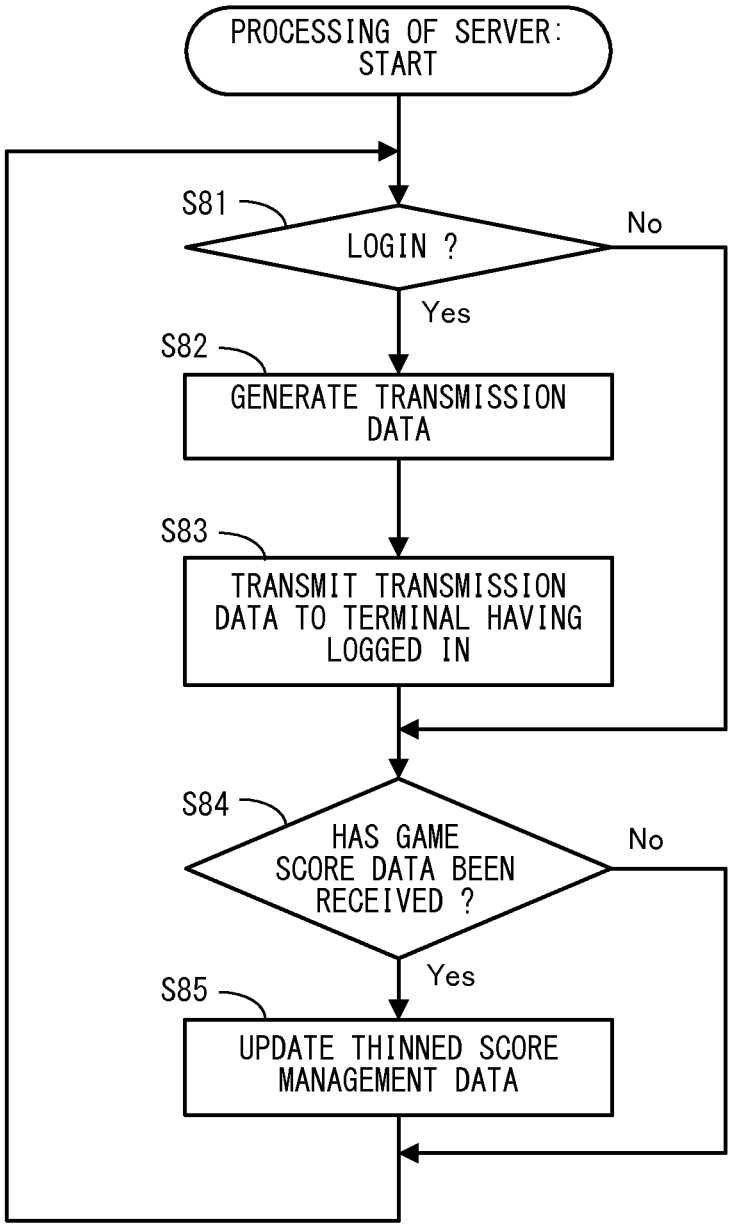
FIG. 12 is a flow chart showing a non-limiting example of the processing performed by the server 200.

Next, with reference to FIGS. 10 to 12, detailed descriptions are given of the processing performed by each information processing apparatus 3 and the server 200. It should be noted that FIGS. 10 and 11 are flow charts showing an example of the processing performed by each information processing apparatus 3. FIG. 12 is a flow chart showing an example of the processing performed by the server 200. Here, in the flow charts shown in FIGS. 10 to 12, descriptions are given mainly of, in the processing performed by the information processing system 1, the process of calculating and displaying world ranking points. Detailed descriptions of other processes not directly related to these processes are omitted. Further, in FIGS. 10 to 12, all the steps performed by the control section 31 and the control section 202 are abbreviated as "S".

It should be noted that the processes of all the steps in the flow charts shown in FIGS. 10 to 12 are merely illustrative. Thus, the processing order of the steps may be changed, or another process may be performed in addition to and/or instead of the processes of all the steps, so long as similar results are obtained. Further, in the exemplary embodiment, descriptions are given on the assumption that the control section 31 (the CPU) or the control section 202 (the CPU) performs the processes of all the steps in the flow charts. Alternatively, the control section 31 (the CPU) or the control section 202 (the CPU) may perform the processes of some of the steps in the flow charts, and a processor or a dedicated circuit other than the control section 31 (the CPU) or the control section 202 (the CPU) may perform the processes of the other steps. Yet alternatively, a processor or a dedicated circuit other than the control section 31 (the CPU) or the control section 202 (the CPU) may perform the processes of all the steps in the flow charts.

First, a description is given of the processing performed by each information processing apparatus 3. The CPU of the control section 31 initializes a memory and the like of the storage section 32 and loads the information processing program from the program storage section 33 into the memory. Then, the CPU starts the execution of the information processing program. The flow charts shown in FIGS. 10 and 11 are flow charts showing the processing performed after the above processes are completed. It should be noted that if there is data (e.g., ranking distribution data, highest score data, transmission flag data, and the like) saved in game processing in the past, the CPU first loads the information processing program into the memory, and then initializes the ranking distribution data De, the game score data Dh, and the like using the saved data.

Referring to FIG. 10, the control section 31 determines whether or not the information processing apparatus 3 is to log in to the server 200 (step 41). For example, with reference to the operation data Da, if the user has performed a login operation using the input section 34, the control section 31 determines that the information processing apparatus 3 is to log in. Then, if the information processing apparatus 3 is to log in, the processing proceeds to step 42. If, on the other hand, the information processing apparatus 3 is not to log in or has already logged in, the processing proceeds to step 50.

In step 42, the control section 31 transmits login data to the server 200, and the processing proceeds to the next step. For example, with reference to the user ID data Db, the control section 31 transmits, as login data, data representing the user ID indicating the user of the information processing apparatus 3 to the server 200.

Next, the control section 31 acquires ranking distribution data and thinning rate data from the server 200 (step 43), and the processing proceeds to the next step. For example, the control section 31 stores the acquired ranking distribution data and thinning rate data in the ranking distribution data De and the thinning rate data Df, respectively, in accordance with the corresponding mode type (game type).

Next, the control section 31 determines whether or not a transmission flag is set to on (step 44). For example, with reference to the transmission flag data Dh3, if there is game score data for which the transmission flag is set to on, the determination is affirmative in the above step 44. Then, if a transmission flag is set to on, the processing proceeds to step 45. If, on the other hand, a transmission flag is not set to on, the processing proceeds to step 47.

In step 45, the control section 31 transmits to the server 200 the game score data for which the transmission flag is set to on, and the processing proceeds to the next step. For example, the control section 31 transmits to the server 200 the highest score data Dh2 for which the transmission flag is set to on, together with type data representing the type of the mode (the type of the game) in which the highest score has been recorded. Here, the state where a transmission flag is on at the time of the login indicates that it has been determined in the past that game score data was to be transmitted to the server 200 in the state where the information processing apparatus 3 has not logged in. In this case, pieces of game score data for which the transmission flags are set to on are transmitted together at the time of the login.

Next, the control section 31 sets the transmission flag to off (step 46), and the processing proceeds to step 47. For example, the control section 31 sets the transmission flag set for the user score data transmitted in the above step 45 to off, thereby updating the transmission flag data Dh3.

In step 47, the control section 31 calculates a numerical value for setting a score output target, and the processing proceeds to the next step. For example, the control section 31 calculates, as a numerical value for setting a score output target, the remainder obtained by dividing the user ID (the account ID) stored in the user ID data Db by the numerical value of the thinning rate transmitted from the server 200 and stored in the thinning rate data Df.

Next, the control section 31 determines whether or not the user of the information processing apparatus 3 itself is a score output target (step 48). For example, if the modes ID represented by the mode ID data Dd include a mode ID that matches the numerical value of the above remainder, the determination is affirmative in the above step 48, and the processing proceeds to step 49. If, on the other hand, the modes ID represented by the mode ID data Dd do not include a mode ID that matches the numerical value of the above remainder, the determination is negative in the above step 48, and the processing proceeds to step 50.

In step 49, the control section 31 sets the score output target flag for the mode in which the user of the information processing apparatus 3 itself is a score output target, to on, and the processing proceeds to step 50. For example, the control section 31 sets the score output target flag corresponding to the mode indicated by the mode ID that matches the numerical value of the above remainder, to on, thereby updating the score output target flag data Dg.

In step 50, the control section 31 determine whether or not the game is to be started. For example, with reference to the operation data Da, if the user has performed the operation of starting the game, using the input section 34, the control section 31 determines that the game is to be started. Then, if the game is to be started, the processing proceeds to step 51. If, on the other hand, the game is not to be started, the processing proceeds to step 41.

In step 51, the control section 31 initializes the game, and the processing proceeds to step 61 (see FIG. 11). For example, in the above initialization, the control section 31 initializes parameters for performing the following game processing.

Referring to FIG. 11, in step 61, the control section 31 performs game processing regarding the started game using the operation data Da. Then, the control section 31 calculates a game score corresponding to the game processing (step 62), and the processing proceeds to the next step. For example, the control section 31 updates the real-time score data Dh1 as needed, using the calculated game score.

Next, the control section 31 calculates world ranking points (step 63), and the processing proceeds to the next step. For example, using the ranking distribution data De and the real-time score data Dh1, the control section 31 calculates the ranking of the user of the information processing apparatus 3 itself in a list of rankings for the mode in which the game is being played, thereby updating the user ranking data Di using the calculated ranking. Then, the control section 31 calculates world ranking points corresponding to the calculated user ranking, thereby updating the world ranking points data Dj using the calculated world ranking points. It should be noted that an example of the method of calculating the user ranking and the world ranking points is similar to the method described with reference to FIGS. 4 to 7, and therefore is not described in detail here.

Next, the control section 31 displays a game image, the game score, and the world ranking points on the display section 35 (step 64), and the processing proceeds to the next step. As is clear from the processes of the above steps 61 to 64, if the game score gained by the user has increased and/or decreased, the world ranking points corresponding to the game score having increased and/or decreased are calculated and displayed together with a game image on the display section 35. Thus, the world ranking points are displayed in real time in conjunction with an increase and/or a decrease in the game score.

Next, the control section 31 determines whether or not the game processing is to be ended (step 65). Examples of conditions for ending the game processing include: the satisfaction of the condition under which the game processing is ended (e.g., the game is over or the game is completed); and the fact that the user has performed the operation of ending the game processing. If the game processing is not to be ended, the control section 31 returns to the above step 61 and repeats the process thereof. If the game processing is to be ended, the processing proceeds to step 66.

In step 66, the control section 31 determines whether or not the highest score of the user themselves has been updated in the game (mode) ended in the above step 65. For example, when the real-time score data Dh1 and the highest score data Dh2 are set for the same mode and if the score represented by the real-time score data Dh1 (i.e., the user score in the game ended in the above step 65) is better than the score represented by the highest score data Dh2 (i.e., the highest score of the user themselves in the above game), the determination is affirmative in the above step 66. Then, if the highest score of the user themselves has been updated, the processing proceeds to step 67. If, on the other hand, the highest score of the user themselves has not been updated, the processing proceeds to step 75.

In step 67, the control section 31 updates highest score data, and the processing proceeds to the next step. For example, using the score represented by the real-time score data Dh1, the control section 31 updates the highest score data Dh2 set for the same mode.

Next, the control section 31 determines whether or not the top ranking score in the list of rankings for the mode in which the game has been played has been updated using the highest score of the user themselves updated in the above step 67 (step 68). For example, when the highest score data Dh2 and the acquired score data De1 are set for the same mode and if the score represented by the highest score data Dh2 (i.e., the highest score of the user themselves updated in the above step 67) is better than the score in the top ranking represented by the acquired score data De1 (i.e., the top ranking score in the list of rankings for the mode in which the game has been played), the determination is affirmative in the above step 68. Then, if the top ranking score has not been updated using the highest score of the user themselves, the processing proceeds to step 69. If, on the other hand, the top ranking score has been updated using the highest score of the user themselves, the processing proceeds to step 70.

In step 69, the control section 31 determines whether or not the user of the information processing apparatus 3 itself is set as a score output target for the mode in which the game has been played. For example, the control section 31 extracts from the score output target flag data Dg a score output target flag corresponding to the mode in which the game has been played. If the score output target flag is set to on, the control section 31 determines that the user of the information processing apparatus 3 itself is set as a score output target. Then, if the user of the information processing apparatus 3 itself is set as a score output target, the processing proceeds to step 70. If, on the other hand, the user of the information processing apparatus 3 itself is not set as a score output target, the processing proceeds to step 75.

In step 70, the control section 31 sets a transmission flag corresponding to the game mode that is a transmission target, to on, and the processing proceeds to the next step. For example, the control section 31 sets a transmission flag corresponding to the game mode in which the highest score data has been updated in the above step 67, to on, thereby updating the transmission flag data Dh3.

Next, the control section 31 determines whether or not the information processing apparatus 3 is in the state of logging in to the server 200 (step 71). Then, if the information processing apparatus 3 is in the login state, the processing proceeds to step 72. If, on the other hand, the information processing apparatus 3 is not in the login state, the processing proceeds to step 74.

In step 72, the control section 31 transmits game score data to the server 200 to which the information processing apparatus 3 is in the state of logging in, and the processing proceeds to the next step. For example, with reference to the transmission flag data Dh3, the control section 31 extracts a game mode for which the transmission flag is set to on, sets the highest score data Dh2 corresponding to the game mode and data representing the game mode as game score data to be transmitted to the server 200, and transmits the game score data to the server 200.

Next, the control section 31 sets all the transmission flags set to on, to off, and the processing proceeds to step 74. For example, the control section 31 sets all the transmission flags corresponding to the game mode in which the game score data has been transmitted in the above step 72, to off, thereby updating the transmission flag data Dh3.

In step 74, the control section 31 sets a score output target flag to off, and the processing proceeds to step 75. For example, the control section 31 sets a score output target flag corresponding to the game mode for which the transmission flag has been set to on in the above step 70, to off, thereby updating the score output target flag data Dg.

In step 75, the control section 31 determines whether or not the processing is to be ended. Examples of conditions for ending the processing include: the satisfaction of the condition under which the processing is ended; the fact that the user has performed the operation of ending the processing; and the like. If the processing is not to be ended, the control section 31 returns to the above step 41 (see FIG. 10), and repeats the process thereof. If the processing is to be ended, the control section 31 ends the processing indicated in the flow charts.

Next, a description is given of the processing performed by the server 200. Referring to FIG. 12, the control section 202 of the server 200 determines whether or not a login request has been received from an information processing apparatus 3 (step 81). For example, if a user ID has been transmitted from an information processing apparatus 3 making a login request, the control section 202 authenticates the account using the user ID, thereby confirming login rights. Then, if the control section 202 has succeeded in confirming the login rights of the information processing apparatus 3 making the login request, the processing proceeds to step 82. If, on the other hand, a login request has not been received, or if the control section 202 has failed in confirming the login rights of the information processing apparatus 3 making the login request, the processing proceeds to step 84.

In step 82, the control section 202 generates transmission data, and the processing proceeds to the next step. For example, the control section 202 generates, among pieces of data of game scores managed in the thinned score management data Dp, a predetermined number of pieces of data (e.g., pieces of data describing 50 game scores) and data representing a thinned ranking managed as the bottom ranking (the ranking N in the example of FIG. 6), as ranking distribution data for each mode. Then, the control section 202 adds, to the generated ranking distribution data, the thinning rate data Dq indicating a thinning rate corresponding to each mode of the ranking distribution data, thereby updating the transmission data Dr. It should be noted that an example of the method of generating the ranking distribution data and the thinning rate data is similar to the method described with reference to FIGS. 4 to 7, and therefore is not described in detail here.

Next, the control section 202 transmits the transmission data to the information processing apparatus 3 having logged in (step 83), the processing proceeds to step 84. For example, the control section 202 transmits the transmission data stored in the transmission data Dr to the information processing apparatus 3 having logged in.

In step 84, the control section 202 determines whether or not game score data has been received. Then, if game score data has been received, the processing proceeds to step 85. If, on the other hand, game score data has not been received, the control section 202 returns to the above step 81 and repeats the process thereof.

In step 85, the control section 202 updates thinned score management data using the received game score data, returns to the above step 81, and repeats the process thereof. For example, the control section 202 adds the game score represented by the game score data to thinned score management data corresponding to the type of the mode (the type of the game) represented by the received game score data, such that the added game score is at a position corresponding to the superiority or inferiority of the game score. Then, the control section 202 describes the added game score, thereby updating the thinned score management data Dp.

As described above, on a display screen that can be displayed by the information processing apparatus 3, world ranking points based on a user ranking are displayed. The world ranking points are such that the higher the ranking, the greater the value. This can enhance the motivation of the user by displaying the world ranking points. Further, even if the user participating in a list of rankings is in the same ranking, the numerical value of the world ranking points increases as the total number of users participating in the list of rankings increases. Thus, even if the number of users increase and the user ranking falls, the numerical value of the world ranking points does not necessarily decrease. Thus, it is possible to enhance the motivation of the user by displaying the world ranking points, as compared to when a simple user ranking is displayed.

It should be noted that the ranking distribution data and the thinning rate data to be transmitted from the server 200 to the information processing apparatus 3 may be transmitted so as to correspond to all the modes that can be played using the information processing apparatus 3, or may be transmitted by narrowing down all the modes to only modes to be played using the information processing apparatus 3 immediately after the login. In the second case, at the time of the login, the information processing apparatus 3 transmits, to the server 200, data representing game modes to be played immediately after the login. This enables the server 200 to transmit, to the information processing apparatus 3 having logged in, only data related to the game mode represented by the transmitted data. In this case, the information processing apparatus 3 can also reduce the amount of data stored in the ranking distribution data De and managed and also reduce the processing load of each determination. Further, a thinning rate set by the server 200 may be a common value among all the modes (all the games). In this case, the server 200 only transmits thinning rate data indicating the common value to the information processing apparatus 3, whereby also the information processing apparatus 3 can set the thinning rate corresponding to all the modes (all the games). This can also reduce the amount of data transmitted from the server 200 to the information processing apparatus 3.

In addition, in the above description, an example has been used where world ranking points are displayed to enhance the motivation of the user. Alternatively, the world ranking points may be used for another purpose. For example, the content of game processing may change in accordance with the number of points of the world ranking points. As an example, an enemy object having strength corresponding to the number of points of the world ranking points may appear, thereby adjusting the level of difficulty of the game. Alternatively, the ability of a player object may change in accordance with the number of points of the world ranking points. Yet alternatively, if a game is performed where a plurality of users compete against each other, a user against which to compete may be selected in accordance with the number of points of the world ranking points. Yet alternatively, if the number of points of the world ranking points is equal to or greater than a predetermined value, a rare character or item may appear in a game. Yet alternatively, a game mode that can be performed only if the number of points of the world ranking points is equal to or greater than a predetermined value may be set.

In addition, in the above description, game processing has been used as an example of the information processing in which world ranking points are calculated. Alternatively, world ranking points may be calculated in accordance with a user ranking based on the result of another type of processing. For example, a user ranking may be calculated based on the result of a common test taken by a plurality of users, and world ranking points may be calculated based on the user ranking. Alternatively, world ranking points may be calculated in accordance with a user ranking based on the result of information processing performed by executing learning software or training software. In this case, the world ranking points of the user based on the learning result or the training result of the user in the information processing are presented to the user.

In addition, the above descriptions are given using an example where each information processing apparatus 3 and the server 200 perform the information processing. Alternatively, another apparatus may perform at least some of the processing steps in the information processing. For example, if the information processing apparatus 3 is further configured to communicate with another apparatus (e.g., another server, another game apparatus, or another mobile terminal), the other apparatus may cooperate to perform the processing steps of the information processing. Alternatively, the information processing apparatus 3 or another apparatus may perform part of the processing performed by the server 200. Another apparatus may thus perform at least some of the processing steps in the information processing, which enables information processing similar to that described above. Further, the information processing described above can be performed by a processor or the cooperation of a plurality of processors, the processor or the plurality of processors included in an information processing system including at least one information processing apparatus and a server. Further, in the exemplary embodiment, the processing indicated in the flow charts described above is performed by the control section 31 of the information processing apparatus 3 and the control section 202 of the server 200 executing a predetermined program. Alternatively, part or all of the processing indicated in the flow charts may be performed by a dedicated circuit included in the information processing apparatus 3 and a dedicated circuit included in the server 200.

Here, the above variations make it possible to achieve the exemplary embodiment also by a system form such as cloud computing, or a system form such as a distributed wide area network or a local area network. For example, in a system form such as a distributed local area network, it is possible to execute the processing between a stationary information processing apparatus (a stationary game apparatus) and a handheld information processing apparatus (a handheld game apparatus) by the cooperation of the apparatuses. It should be noted that, in these system forms, there is no particular limitation on which apparatus performs the process of each step described above. Thus, it goes without saying that it is possible to achieve the exemplary embodiment by sharing the processing in any manner.

In addition, the processing orders, the setting values, the conditions used in the determinations, and the like that are used in the information processing described above are merely illustrative. Thus, it goes without saying that the exemplary embodiment can be achieved also with other orders, other values, and other conditions.

In addition, the information processing program (e.g., a game program) may be supplied to each information processing apparatus 3 and the server 200 not only through an external storage medium such as the external memory 45, but also through a wired or wireless communication link. Further, the program may be stored in advance in a non-volatile storage device included in the information processing apparatus 3 and the server 200. It should be noted that examples of an information storage medium having stored therein the program may include CD-ROMs, DVDs, optical disk storage media similar to these, flexible disks, hard disks, magneto-optical disks, and magnetic tapes, as well as non-volatile memories. Alternatively, an information storage medium having stored therein the program may be a volatile memory for storing the program. It can be said that such a storage medium is a storage medium readable by a computer or the like. For example, it is possible to provide the various functions described above by causing a computer or the like to load a program from the storage medium and execute it.

While some exemplary systems, exemplary methods, exemplary devices, and exemplary apparatuses have been described in detail above, the above descriptions are merely illustrative in all respects, and do not limit the scope of the systems, the methods, the devices, and the apparatuses. It goes without saying that the systems, the methods, the devices, and the apparatuses can be improved and modified in various manners without departing the spirit and scope of the appended claims. It is understood that the scope of the systems, the methods, the devices, and the apparatuses should be interpreted only by the scope of the appended claims. Further, it is understood that the specific descriptions of the exemplary embodiment enable a person skilled in the art to carry out an equivalent scope on the basis of the descriptions of the exemplary embodiment and general technical knowledge. It should be understood that, when used in the specification, the components and the like described in the singular with the word "a" or "an" preceding them do not exclude the plurals of the components. Furthermore, it should be understood that, unless otherwise stated, the terms used in the specification are used in their common meanings in the field. Thus, unless otherwise defined, all the jargons and the technical terms used in the specification have the same meanings as those generally understood by a person skilled in the art in the field of the exemplary embodiment. If there is a conflict, the specification (including definitions) takes precedence.

The exemplary embodiment is useful as an information processing system, an information processing apparatus, a server, an information processing program, an information processing method, and the like in order, for example, to enhance the motivation of a user.

What is claimed is:

1. An information processing system for performing display based on rankings of a plurality of users, the information processing system having processing circuitry comprising at least a memory and one or more processors, the processing circuitry configured to:

set the ranking of each of the plurality of users based on game scores gained in association with each of the plurality of users performance when participating in a game, the ranking of each user set based on a ranking of the user with respect to a total number of users participating in the game;

calculate a reference point value using a value obtained by subtracting a numerical value indicating the ranking from the total number of users participating in the game, wherein the smaller the numerical value indicating the ranking, the greater the calculated reference point value is for each user; and generate a user interface for display that incorporates at least the reference point value calculated for the user in the display of the user interface.

2. The information processing system according to claim 1, wherein the processing circuitry of the information processing system is further configured to execute at least one application, a plurality of modes are set in the application, in the setting of the ranking, the ranking of the user is set with respect to each mode, and the reference point value is calculated with respect to the mode.

3. The information processing system according to claim 2, wherein even in the same application, the mode is set to different modes between when a single user executes the application and when a plurality of users execute the application.

4. The information processing system according to claim 1, further comprising a terminal apparatus and a server, wherein the server comprises one or more processors configured to perform the setting of the ranking, the terminal apparatus comprises one or more processors configured to:

acquire information indicating some of the rankings of the users from the server; and calculate a ranking of a user of the terminal apparatus using the information, wherein the reference point value is calculated for the user of the terminal apparatus using the calculated ranking of the user.

5. The information processing system according to claim 4, wherein the one or more processors of the server are further configured to at least output, as the information, data representing scores corresponding to some of the rankings, and in the calculation of the ranking of the user, interpolation is performed based on the information using the scores to be set in rankings other than some of the rankings indicated by the information, and the ranking of the user of the terminal apparatus is calculated using a result of the interpolation and a score of the user.

6. The information processing system according to claim 1, further comprising a plurality of terminal apparatuses and a server, wherein the server comprises one or more processors configured to perform the setting of the ranking, each of the terminal apparatuses comprises one or more processors configured to:

output data representing a score of a user of the terminal apparatus to the server; and determine, based on a predetermined condition, whether or not to output the data representing the score of the user of the terminal apparatus to the server, the one or more processors of the server are further configured to acquire the data representing the score of the user from each of the plurality of terminal apparatuses, and in the setting of the ranking, the ranking is set using the data representing the score acquired from each of the plurality of terminal apparatuses.

7. The information processing system according to claim 6, wherein the one or more processors of the server are further configured to output, to each of the plurality of terminal apparatuses, data representing a condition of the terminal apparatus that is a target from which the data representing the score of the user of the terminal apparatus is acquired, the one or more processors of the terminal apparatus are further configured to acquire the data representing the condition from the server, and in the determination of the output, it is determined, using the acquired condition and an identification code uniquely set for the terminal apparatus or the user, whether or not the terminal apparatus is the target.

8. The information processing system according to claim 1, wherein in the setting of the ranking, rankings of scores of users set in a top ranking and a bottom ranking in the rankings of the plurality of users and rankings of scores of users set in rankings thinned in a predetermined proportion between the top ranking and the bottom ranking are set based on superiority or inferiority of the scores of the users, the processing circuitry of the information processing system is further configured to perform interpolation based on the scores in the thinned rankings and the proportion, and based on a result of the interpolation, calculate a ranking of a certain user corresponding to a score of the certain user, wherein the reference point value is calculated for the certain user using the calculated ranking of the certain user.

9. The information processing system according to claim 1, wherein the processing circuitry of the information processing system is further configured to execute at least one application, in the calculation of the reference point value, in accordance with a score obtained by executing the application, the reference point value is calculated as needed during the execution, and in the display of the reference point value, an application image regarding the application is displayed together with the score obtained during the execution of the application and an image representing the reference point value corresponding to the obtained score.

10. The information processing system according to claim 1, wherein the reference point value is calculated by subtracting the numerical value indicating the ranking from the total number of users participating in the game and adding a numerical constant.

11. The information processing system of claim 1, wherein the ranking of each of the plurality of users is thinned using at least a thinning rate and a bottom thinned ranking.

12. The information processing system of claim 1, wherein the game scores are determined based on the users performance when participating in the game and the numerical value indicating the ranking is determined using the game scores, and the reference point value is then calculated using, at least, the numerical value indicating the ranking, that is determined using the game scores.

13. The information processing system of claim 1, wherein the reference point value corresponds to a world ranking point value, and the world ranking point value is displayed in the user interface along with a game score associated with the user.

14. The information processing system of claim 1, wherein the reference point value increases as the total number of users participating in the game increases.

15. An information processing apparatus for performing display based on rankings of a plurality of users, the information processing apparatus having processing circuitry comprising at least a memory and one or more processors, the processing circuitry configured to:

acquire information in which the ranking of each of the plurality of users is set based on game scores gained in association with each of the plurality of users performance when participating in a game, the ranking of each user set based on a ranking of the user with respect to a total number of users participating in the game;

calculate a reference point value using a value obtained by subtracting a numerical value indicating the ranking from the total number of users participating in the game, wherein the smaller the numerical value indicating the ranking, the greater the calculated reference point value is for each user; and generate a user interface for display that incorporates at least the reference point value calculated for the user in the display of the user interface.

16. A server for managing information based on rankings of a plurality of users participating in a game, the server having processing circuitry comprising at least a memory and one or more processors, the processing circuitry configured to:

output data representing a condition for acquiring data representing a score of each of the plurality of users, to a terminal apparatus of the user;

acquire, from the terminal apparatus, data representing a score of the user output based on the condition and gained as the user participates in the game;

set and manage a ranking of the score based on a ranking of the user with respect to a total number of users participating in the game; and output data representing at least some of scores managed in the setting of the ranking to the terminal apparatus, the scores including scores of users in a top ranking and a bottom ranking, the output data further including a reference point value calculated using a value obtained by subtracting a numerical value indicating the ranking from the total number of users participating in the game.

17. A non-transitory computer-readable storage medium having stored therein an information processing program executed by a computer included in an information processing apparatus for performing display based on rankings of a plurality of users, the information processing program causing the computer to execute:

acquiring information in which the ranking of each of the plurality of users is set based on game scores gained in association with each of the plurality of users performance when participating in a game, the ranking of each user set based on a ranking of the user with respect to a total number of users participating in the game;

calculating a reference point value using a value obtained by subtracting a numerical value indicating the ranking from the total number of users participating in the game, wherein the smaller the numerical value indicating the ranking, the greater the calculated reference point value is for each user; and generating a user interface for display that incorporates at least the reference point value calculated for the user in the display of the user interface.

18. An information processing method performed by a processor or cooperation of a plurality of processors, the processor or the plurality of processors included in an information processing system for performing display based on rankings of a plurality of users, the information processing method comprising:

setting the ranking of each of the plurality of users based on game scores gained in association with each of the plurality of users performance when participating in a game, the ranking of each user set based on a ranking of the user with respect to a total number of users participating in the game;

calculate a reference point value using a value obtained by subtracting a numerical value indicating the ranking from the total number of users participating in the game, wherein the smaller the numerical value indicating the ranking, the greater the calculated reference point value is for each user; and generating a user interface for display that incorporates at least the reference point value calculated for the user in the display of the user interface.

19. An information processing system, comprising:

a processor; and a memory configured to store computer readable instructions that, when executed by the processor, cause the information processing system to:

determine a ranking of each user, from a plurality of users participating in a game associated with the information processing system, based on a game score associated with performance of each user as each user participates in the game, the ranking of each user having a numerical value associated with the ranking;

determine a total number of the plurality of users participating in the game;

calculate a ranking point value for each user using a value obtained by subtracting the numerical value associated with the ranking of each user from the total number of users participating in the game; and generate for display a user interface that incorporates at least the calculated ranking point value for a respective user as the user participates in the game.

20. The system of claim 19, wherein the ranking point value is larger when the numerical value associated with the ranking of the user is lower, and the ranking point value is smaller when the numerical value associated with the ranking of the user is higher.

* * * * *